United States Patent [19]

Heitlinger

[11] 4,328,892

[45] May 11, 1982

[54] DENTAL HYGIENE CASE

[76] Inventor: Paul Heitlinger, Chemnitzer Strasse 15, 6054 Rodgau 3 (Nieder-Roden), Fed. Rep. of Germany

[21] Appl. No.: 178,693

[22] Filed: Aug. 18, 1980

[30] Foreign Application Priority Data

Aug. 23, 1979 [DE] Fed. Rep. of Germany ..... 2934047

[51] Int. Cl.[3] ..... A45D 44/18; B65D 77/00

[52] U.S. Cl. ..... 206/229; 206/63.5; 206/369; 206/38; 132/84 B

[58] Field of Search ..... 206/369, 228, 229, 380, 206/63.5, 209.1, 38; 132/84 B, 80 R

[56] References Cited

U.S. PATENT DOCUMENTS

| | | | |
|---|---|---|---|
| 2,284,217 | 5/1942 | Lieberthal | 206/229 |
| 2,491,207 | 12/1949 | Preble, Jr. et al. | 132/84 B |
| 2,512,001 | 6/1950 | Terry | 206/63.5 |
| 2,576,551 | 11/1951 | Waters | 106/229 |
| 2,965,109 | 12/1960 | Borah | 206/229 |
| 4,269,313 | 5/1981 | Smith | 206/380 |

*Primary Examiner*—William T. Dixson, Jr.
*Attorney, Agent, or Firm*—Biebel, French & Nauman

[57] ABSTRACT

The present invention provides a case-like container having plastic walls, for keeping items used in dental hygiene in which a substantial portion of the container is in the form of a beaker around which there is disposed a folded toothbrush within walls that can at least be partially torn off.

7 Claims, 5 Drawing Figures

DENTAL HYGIENE CASE

The present invention relates to a case-like container having plastic walls for keeping items used in dental hygiene, such as a toothbrush, toothpaste and a beaker.

A case-like container of the type described above, in which a plastic case having rounded corners is made by deep drawing on a square cardboard base and glued or welded thereto, is already on the market. In the space formed between these plastic walls and the level cardboard wall there is disposed a small beaker, a small tube of toothpaste and a toothbrush, which, if required, is provided with a telescopic handle or a collapsible handle. These containers for items for oral hygiene are used, for example, by mountaineers, who can brush their teeth only if water is available. However, not only in sports, for example, hiking, sailing, or quite generally vehicle sports does a need exist for usefully packaged dentifrices, etc., but this need for having these items quickly available can also exist for travellers or in many households, particularly when after the closing hours of stores these items are no longer available in the usual stores.

In fact self-service machines exist for a variety of items, as for example, food, tickets, photographic articles and magazines. However, dentrifices are not yet sold in self-service machines.

The present invention provides a container of the aforesaid type, i.e., a container by means of which items for oral hygiene can be offered to the consumer everywhere and also if desired in self-service machines, irrespective of time and place.

According to the present invention there is provided a case-like container having plastic walls, for keeping items used in dental hygiene in which a substantial portion of the container is in the form of a beaker around which there is disposed a folded toothbrush within walls that can at least be partially torn off.

Thus, according to the invention a substantial portion of the case-like container is formed as a beaker filled with a liquid and on which there is disposed a folded toothbrush within walls, which can at least be partially torn off. This kind of container may have, for example, the size of the conventional cigarette packages, particularly $5\times8\times2$ cm. Any self-service machine dispensing cigarettes can be entirely or partially converted in a favorable manner to a machine dispensing dentifrices. This is economically of interest since the number of smokers is gradually decreasing. Moreover, the manufacturers of cigarette-dispensing machines have the corresponding tools, so that corresponding self-service machines, if required, produced in smaller sizes only for dentifrices, can be used without new designs.

The case-like container according to the invention is a disposable article. The small container is bought and thrown away after using it. It can be easily carried and readily stowed in small pockets.

By "case-like" is of course meant merely a shape which resembles in its nature a case. It can of course have rounded corners or walls which can also be slightly bulged outwardly or inwardly. The above advantages of favorable handling and the use in self-service machines in accordance with the invention are not restricted to the exact geometric square shape.

According to the invention the container is divided into at least two different compartments, a substantial portion serving as a beaker and at least a further portion being adapted to the shape of the stowed folded toothbrush on the one hand and to the beaker on the other in such a way that externally the case-like shape is retained. For example, a portion of the handle of the tooth-brush along an external wall can be contained in a tubular part while the portion with the bristles, bent at an angle to said handle, is housed within and along a further wall of the container. These walls adjacent to the brush portion, and/or to the handle can be at least partially torn off. It is possible, for example, to tear off the entire strip which encompasses the toothbrush on one side and can constitute two narrow sides, in order to remove the toothbrush. In another embodiment it is possible that only a portion is torn off in a narrow side of the container so that the toothbrush is then removable, the container being briefly turned upside down so that the handle or the bristle portion slides out of its recess. This arrangement of the folded toothbrush adjacent to the beaker in a manner such that even upon opening the wall portions adjacent to the toothbrush the beaker remains impervious to liquids assures a very space-saving storage while the function is suitable.

Furthermore, it can be advantageous if a portion of the beaker, preferably at its upper side, is torn off at the same time when tearing off a wall for the removal of the toothbrush so that the toothbrush is practically at hand with one grip and the beaker is open for use. To tear off the wall easily and with little force a tape or a perforated line for pressing and seizing a narrow side of the container as a portion of this wall to be torn off can also be provided.

Moreover, according to the invention it is desirable that the toothbrush has a hinge. For small items a large number of useful shapes can be made from plastics by casting or injection moulding. Thus, for example, it is possible to produce, with low expenditure, a snap hinge, which can be so designed that a toothbrush, folded, e.g., by approximately 10° to 130°, preferably by 30° to 110° and most preferably by less than 90°is stowed in a compartment and upon removing and straightening it so as to form a linear member it is stopped in a small lug or the like catching behind a protrusion. In this manner toothbrushes having the length desired by the consumer can be obtained and, depending on the label and the length of the toothbrush, containers of varying designs and sizes can be offered to the consumer.

In another embodiment it is desirable that the toothbrush has two hinges and, when required it is also impregnated with toothpaste. On using exactly the size mentioned hereinbefore, i.e., $5\times8\times2$ cm, for the case-like container according to the invention, it is possible that only one toothbrush having one hinge merely provides a length which is adequate for a child. In order to provided toothbrushes having substantially longer handles, it is possible to provide, without difficulty, two hinges and to stow a toothbrush, which has, in lateral view, the shape of a U, next to the beaker portion of the container.

The container according to the invention desirably has at least one recess for receiving and retaining tablets, disposed at the front of the container. When brushing teeth it is often expedient to have test tablets available in order to detect particularly endangered, polluted spots in the mouth or teeth affected by caries. Pain-relieving tablets intended particularly for teeth might also be put into this recess. This recess at the front of the container can be very flat, i.e., it requires depth so that despite these recesses a substantial portion, possibly 70 to 80% of the entire case-like container can remain as the beaker.

The container of the invention may desirably have at least one recess for receiving and retaining plastic toothpicks disposed at the front of the container. These toothpicks, which are also known as medical toothpicks, often are useful and can be stowed in the container with the same advantages and with as little loss in volume as the tablets.

In another embodiment of the container a recess for receiving a tube for a few grams of toothpaste is disposed at the narrow side or at the rear end. However, as aforesaid, a toothbrush impregnated with toothpaste can be used but, if desired, a small tube of toothpaste having a content of, e.g., 3 grams, can also be used since it can be stowed in the container without difficulties despite its small size.

In a further embodiment of the container of the invention the liquid consists of water, in which sodium fluoride and, if required, a dye are dissolved. Thus, when buying and using the dentifrices contained in the container according to the invention the user has at his disposal an optimum of articles for the care of the teeth and of the mouth since a mouth wash or the like can also be included instead of the toothpaste.

Externally the container can be so designed that it is particularly attractive, if the plastic walls are transparent, the liquid has a pale rose tint and the individual parts described above are so arranged side by side or one below the other that, for example, the appearance of a face is produced. For example, the mounting crossbar of the medical toothpicks would have the appearance of the mouth and the toothpicks themselves that of teeth; the tablets disposed thereabove would have the appearance of nose and eyes and thereabove the bristles of the brush portion of the toothbrush which might be directed downwards would have the appearance of hair. By suitable colour and arrangements children in particular would be very pleased before, during and after the purchase of this kind of container.

The present invention will be further illustrated by way of the accompanying drawings, in which.

Figure 2:
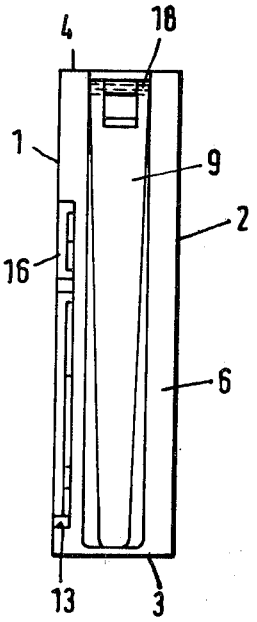
FIG. 2 is a view of the right narrow side of the container when looking from the right to the left in FIG. 1.
Figure 1:
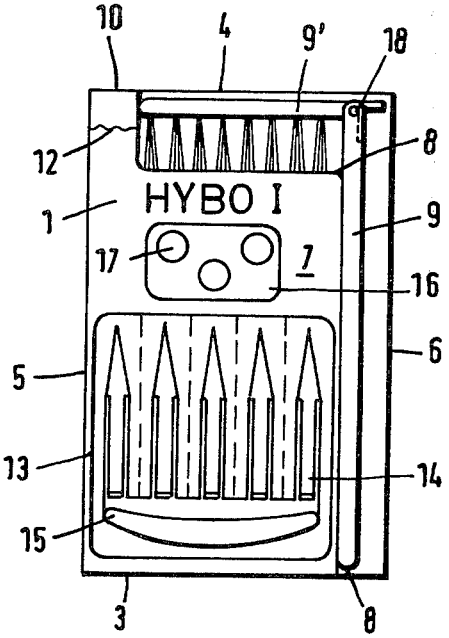
FIG. 1 is a plan view of a container with a toothbrush folded about a hinge in accordance with one embodiment of the present invention.
Figure 3:
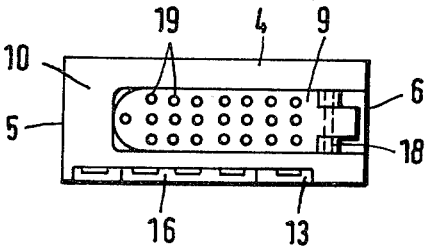
FIG. 3 is a top plan view of the container according to FIG. 1.
Figure 5:
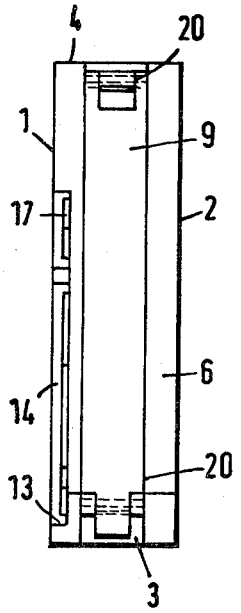
FIG. 5 is a view of the right narrow side of the container of FIG. 4 when looking at the right non-visible narrow side in FIG. 4.
Figure 4:
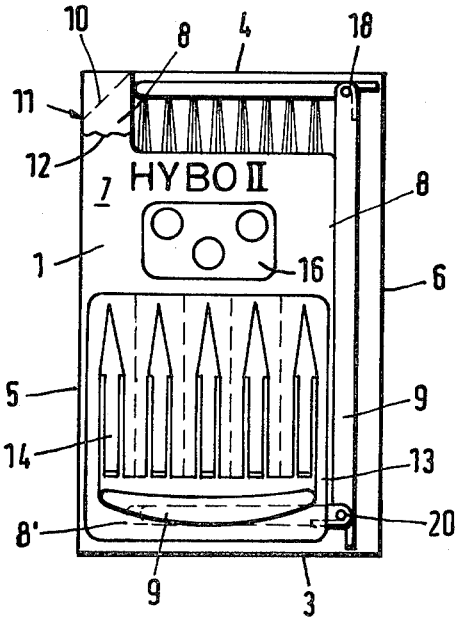
FIG. 4 is similar to that view of FIG. 1 of a container according to a further embodiment of the present invention.

The container according to the FIGS. 1 to 3 on the one hand and according to the FIGS. 4 and 5 on the other is especially shown square-shaped. The wall of the two kinds of container are the wide front wall 1 with the inscription "HYBO I" and "HYBO II", respectively, the wide rear wall 2, the lower and upper short narrow sides 3 and 4 as well as the left and right along narrow sides 5 and 6.

This container is divided into portions, namely a substantial portion of the container forms the beaker 7, whose volume is defined substantially by the left narrow side 5, the lower short narrow side 3 a partition 8 extending from the bottom to the top and bending twice through 90° and the large rear and front walls 1 and 2. The remaining portion accommodates the toothbrush 9. The volume of the latter portion is between said narrow partition 8, the main portion of the upper short narrow side 4, the right long narrow side 6 and the remaining parts of the front and rear walls 1 and 2. The upper narrow side 4 and the left long narrow side 6 can be torn open, i.e., according to the FIGS. 1 and 4 from the top left to the bottom right, starting approximately at the point 10, which forms the opening of the beaker 7 after tearing off the wall portions 4 and 6. In the embodiment according to FIG. 1 this opening 10 can be seen in top plan view in FIG. 3 and is formed by tearing along a horizontal perforated line at the margin of the surfaces of the walls 1, 5 and 2. The opening 10 according to the embodiment shown in FIG. 4 is formed by tearing along an inclined perforated line, tearing upwards at the point marked by the arrow 11 whereupon the narrow sides 4 and 6 are torn off to the corner at the right in FIG. 4.

The liquid contained in the beaker 7 is indicated by the liquid level 12.

In the wide front wall 1 in the two embodiments there is provided a large flat recess 13 for medical toothpicks 14, which are connected by a curved crosspiece 15, and a further flat recess 16 for test tablets or detection tablets 17.

In the embodiment according to the FIGS. 1 to 3 the folded toothbrush 9 has a hinge 18 on the right next to the brush portion 9'. The entire brush 9 is made of plastics since the production of a toothbrush handle of plastics, even with a built-in snap hinge 18, is simple and the production costs are low. The bristles of the portion 9' are secured in a conventional manner in the holes 19 shown in FIG. 3.

In the embodiment according to the FIGS. 4 and 5 the toothbrush 9 has two hinges 18 and 20. In this case the partition 8 between the main portion of the container, the beaker 7 and the portion for receiving the toothbrush 9 must be bent twice at the bottom corresponding to the dotted line 8'. A space for receiving the lower folded portion of the handle is thus provided.

The embodiment of the invention in which an exclusive property or privilege is claimed are defined as follows:

1. A case-like container in form and size of the conventional cigarette package, having at least some walls constructed of a plastic material, for keeping items used in dental hygiene and operable by tearing off at least a portion of at least one wall of the container, in which a substantial portion of the container is in the form of a beaker around which there is disposed a toothbrush having at least one hinge, the toothbrush being contained within walls that can at least be partially torn off.

2. A container according to claim 1, in which the toothbrush has two hinges and is impregnated with toothpaste.

3. A container according to claim 1 or 2, in which a front end has at least one recess for receiving and holding tablets.

4. A container according to any of the claims 1 or 2, in which at least one recess for receiving and holding toothpicks is disposed on a front end of the container.

5. A container according to claim 1 in which a recess for receiving a tube of a few grams of toothpaste is disposed on a narrow side or rear end.

6. A container according to claim 1, in which a said substantial portion of the container is filled with liquid.

7. A container according to claim 1 or 2, in which the liquid is water, in which sodium fluoride and, when required, a dye are dissolved.

* * * * *